US006168285B1

(12) United States Patent
Flohre

(10) Patent No.: US 6,168,285 B1
(45) **Date of Patent: *Jan. 2, 2001**

(54) UNIVERSAL, LIGHT FIXTURE/CEILING FAN RECESSED MOUNTING DEVICE

(76) Inventor: John Gerhard Flohre, 1010 Little Sugar Creek Rd., Kettering, OH (US) 45440

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/965,290

(22) Filed: Nov. 6, 1997

Related U.S. Application Data

(63) Continuation of application No. 08/417,038, filed on Apr. 7, 1997, now Pat. No. 5,502,545.

(51) Int. Cl.[7] ..... F21V 33/00

(52) U.S. Cl. ..... 362/96; 362/149; 362/365; 416/5; 416/244 R

(58) Field of Search ..... 362/96, 364, 365, 362/368, 147; 416/5, 244 R

(56) References Cited

U.S. PATENT DOCUMENTS

| | | | | |
|---|---|---|---|---|
| D. 272,949 | | 3/1984 | Beaty, Sr. | D25/92 |
| D. 295,678 | | 5/1988 | McVey | D23/377 |
| 2,673,291 | * | 3/1954 | Moss | 362/147 |
| 3,299,797 | * | 1/1967 | Dry | 362/147 |
| 3,965,624 | | 6/1976 | Madonna | 52/28 |
| 4,713,916 | | 12/1987 | Brooks, Jr. | 52/39 |
| 4,735,132 | | 4/1988 | Ching | 98/119 |
| 4,809,468 | * | 3/1989 | Bareiss | 362/147 |
| 4,885,668 | * | 12/1989 | Maglica | 362/345 |
| 5,257,775 | | 11/1993 | Burns | 269/41 |
| 5,452,816 | | 9/1995 | Chan et al. | 220/3.8 |
| 5,567,117 | | 10/1996 | Gunn et al. | 416/244 |
| 5,672,002 | * | 9/1997 | Todd | 362/294 |

* cited by examiner

*Primary Examiner*—Stephen Husar
(74) *Attorney, Agent, or Firm*—John D. Gugliotta

(57) ABSTRACT

A device that provides for the recessed mounting of ceiling mounted light fixtures or ceiling fans is disclosed. Comprising a preformed, concave, hemispherical shape, it possesses adequate structural stability and strength for the purposes of mounting a ceiling mounted light fixture or a ceiling fan. The invention provides increases head room below the light fixture or ceiling fan in such instances where the mounting of a desired light fixture or ceiling fan results in inadequate height clearance. The invention also provides enhanced aesthetic qualities when utilized as an architectural element in conjunction with a light fixture or ceiling fan. The invention is a suitable size to be adequately installed between ceiling joists or the floor joists of an upper floor in the cases of a multistory structure. The invention is capable of being manufactured from a wide range of materials using a wide range of manufacturing processes.

7 Claims, 4 Drawing Sheets

UNIVERSAL, LIGHT FIXTURE/CEILING FAN RECESSED MOUNTING DEVICE

RELATED APPLICATIONS

The present invention is a continuation of Disclosure Document Number 08/417,038, filed on Apr. 7, 1997 now U.S. Pat. No. 5,502,545.

BACKGROUND OF THE INVENTION

1. Field of the Invention

The present invention relates generally to mounting fixtures for electrical devices and, more particularly, to a universal, light fixture/ceiling fan recessed mounting device.

2. Description of the Related Art

In the related art, numerous attempts have been made to improve the functionality and aesthetic appearance of ceiling mounted light fixtures and ceiling fans. These improvements have ranged from recessed mounting devices, to hidden mounting devices and the like. A search of the prior art did not disclose any patents that read directly on the claims of the instant invention; however, the following references were considered related:

| U.S. Pat. No. | Inventor | Issue Date |
|---|---|---|
| 5,567,117 | Gunn et al. | Oct. 22, 1996 |
| 5,452,816 | Chan et al. | Sep. 26, 1995 |
| 5,257,775 | Burns | Nov. 2, 1993 |
| 4,735,132 | Ching | Apr. 5, 1988 |
| 4,713,916 | Brooks, Jr. | Dec. 22, 1987 |
| 3,965,624 | Madonna | Jun. 29, 1976 |
| Des. 295,678 | McVey | May 10, 1988 |
| Des. 272,949 | Beaty, Sr. | Mar. 6, 1984 |

Consequently, a need has therefore been felt for an improved but less complex mechanism that allows for a universal, light fixture/ceiling fan recessed mounting device.

SUMMARY OF THE INVENTION

It is therefore an object of the present invention to provide an improved universal, light fixture/ceiling fan recessed mounting device.

It is therefore another object of the present invention to provide for an improved universal, light fixture/ceiling fan recessed mounting device that allows for the recessed mounting of ceiling light fixtures or ceiling fans, commonly referred to as paddle fans to provide for increased headroom below the light fixture or ceiling fan.

It is yet another object of the present invention to provide for an improved universal, light fixture/ceiling fan recessed mounting device that provides enhanced aesthetic qualities when utilized as an architectural element.

It is yet another object of the present invention to provide for an improved universal, light fixture/ceiling fan recessed mounting device that is easily installed in new construction applications as well as retrofit applications.

It is yet another object of the present invention to provide for an improved universal, light fixture/ceiling fan recessed mounting device that is easily installed using common, readily available hand and/or power tools.

Briefly described according to the preferred embodiment of the present invention, the invention comprises a preformed, concave, hemispherical shape, possessing adequate structural stability and strength for the purposes of mounting a ceiling mounted light fixture or a ceiling fan. The invention provides increases head room below the light fixture or ceiling fan in such instances where the mounting of a desired light fixture or ceiling fan results in inadequate height clearance. The invention also provides enhanced aesthetic qualities when utilized as an architectural element in conjunction with a light fixture or ceiling fan. The invention is a suitable size to be adequately installed between ceiling joists or the floor joists of an upper floor in the cases of a multistory structure. The invention is capable of being manufactured from a wide range of materials using a wide range of manufacturing processes.

Another advantage of the present invention is that it is simple, and therefore, inexpensive to manufacture. This savings, if passed on to the consumer, may influence the public to utilize such a device. A simple design also increases product reliability and useful product lifetime.

Another advantage of the present invention is that it is easily installed by the professional or the homeowner with equal results.

Another advantage of the present invention is that it is capable of being painted to allow for its continued use after an interior decorating project has changed the room color scheme.

Another advantage of the present invention is that it is easily produced from a wide range of readily available materials using known manufacturing techniques, thus allowing for an economical and aesthetically pleasing product available in a wide range of colors and finishes. Such capabilities allow for its purchase and utilization by a wide range of consumers across wide economic boundaries.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
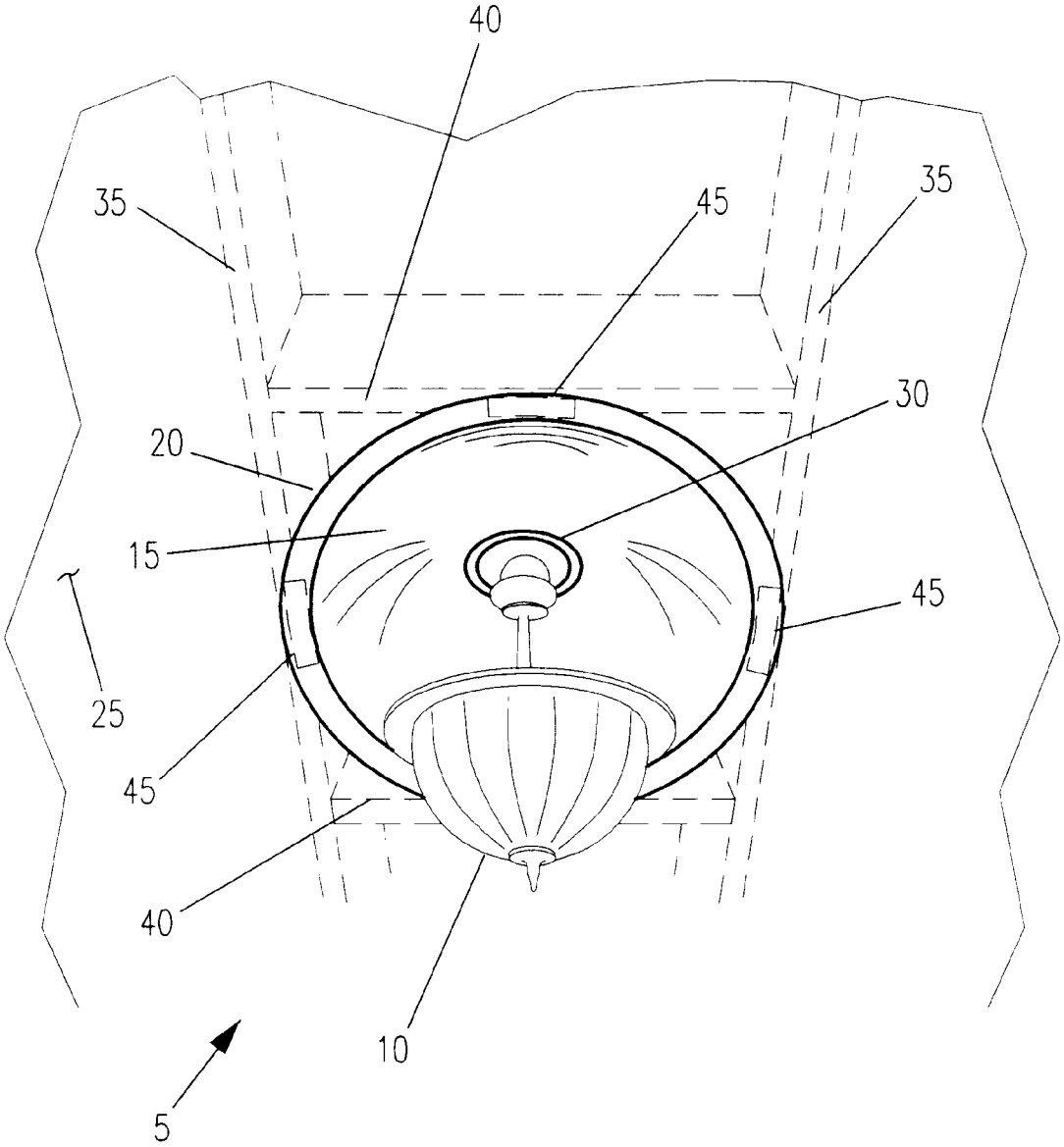
FIG. 1 is a perspective view of the universal, light fixture/ceiling fan recessed mounting device shown in a utilized state with a ceiling mounted light fixture according to the preferred embodiment of the present invention.

Referring now to FIG. 1, a perspective view of the universal, light fixture/ceiling fan, recessed mounting device 5 is shown in a utilized state with a conventional ceiling mount light fixture 10 according to the preferred embodiment of the present invention. A concave, partial hemispherical surface 15 complete with a trim and attachment molding 20 is mounted flush to a ceiling surface 25. The ceiling surface 25 as shown in this FIG. is depicted as drywall with a taped and textured surface as is commonly found. However, it can be seen by those skilled in the art that any type of ceiling surface could be utilized with the universal, light fixture/ceiling fan, recessed mounting device 5. The inverted nature of the concave, partial hemispherical surface 15 allows for a fixture mounting surface 30 to be mounted above the plane formed by the ceiling surface 25 on the order of several inches. The actual dimensions and size of the universal, light fixture/ceiling fan, recessed mounting device 5 vary on several factors such as ceiling support member spacing, the radius of the concave, partial hemispherical surface 15, and the like. A series of ceiling rafter or floor joists 35 are shown as the conventional means of support for the ceiling surface 25, as well as support for the universal, light fixture/ceiling fan, recessed mounting device 5 as will be shown in greater detail hereinbelow. A pair of auxiliary support members 40 are shown in a perpendicular nature to the ceiling rafter or floor joist 35 to provide additional support for the universal, light fixture/ceiling fan, recessed mounting device 5. Such support as provided by the ceiling rafter or floor joist 35 and the auxiliary support member 40, provides a series of four tangential support surfaces 45 depicted by dashed boxes. The universal, light fixture/ceiling fan, recessed mounting device 5 and its concave, partial hemispherical surface 15 are shown as a smooth surface in this FIG., however this is not intended to limit other designs as fluted, textured, embossed patterns, and the like. It is intended that the universal, light fixture/ceiling fan, recessed mounting device 5 would be manufactured from plastic using an injection molding process, however other materials and/or processes could also be utilized. These other materials and/or processes include but are not limited to; fiberglass molding, wood, stamped metal, cast metal, plaster, and the like.

Figure 1A:
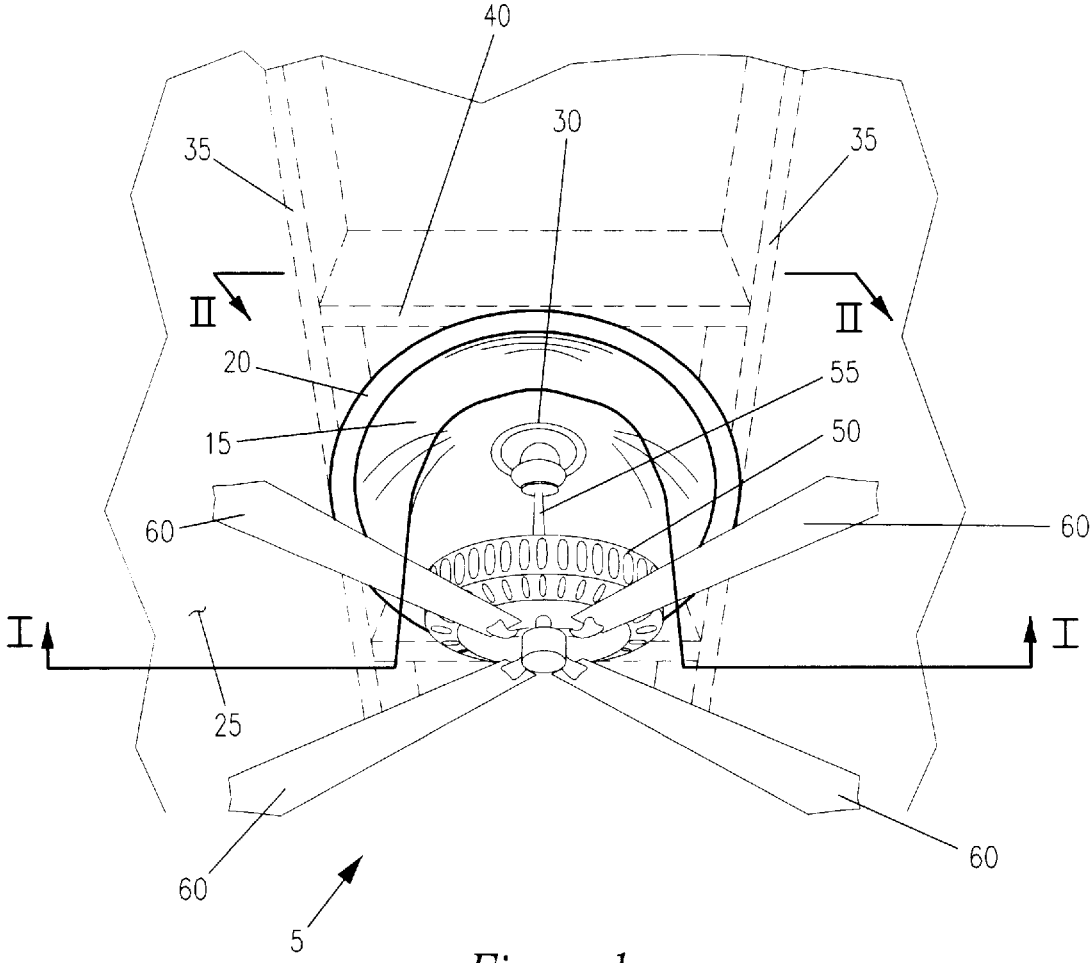
FIG. 1*a* is perspective view of the universal, light fixture/ceiling fan recessed mounting device shown in a utilized state with a ceiling fan according to the alternate embodiment of the present invention.

Referring next to FIG. 1*a*, a perspective view of the universal, light fixture/ceiling fan, recessed mounting device 5 is shown in a utilized state with a ceiling fan 50 according to the preferred embodiment of the present invention. The use of the concave, partial hemispherical surface 15 and the trim and attachment molding 20 in a manner identical to that described with FIG. 1, allows the use of the ceiling fan 50 with a pendant rod 55 as attached to the fixture mounting surface 30 while keeping fan blades 60 in a close proximity to the ceiling surface 25. Such use of the pendant rod 55 allows for greater aesthetic appeal when mounting the ceiling fan 50, but yet allows use of the ceiling fan 50 in areas where decreased head room underneath the ceiling fan 50 cannot be tolerated. The mounting of the universal, light fixture/ceiling fan, recessed mounting device 5 is accomplished in an identical manner as aforementioned described in FIG. 1 with the use of the ceiling rafter or floor joist 35 and the auxiliary support member 40 (of which only one is depicted for illustrative purposes.)

Figure 2:
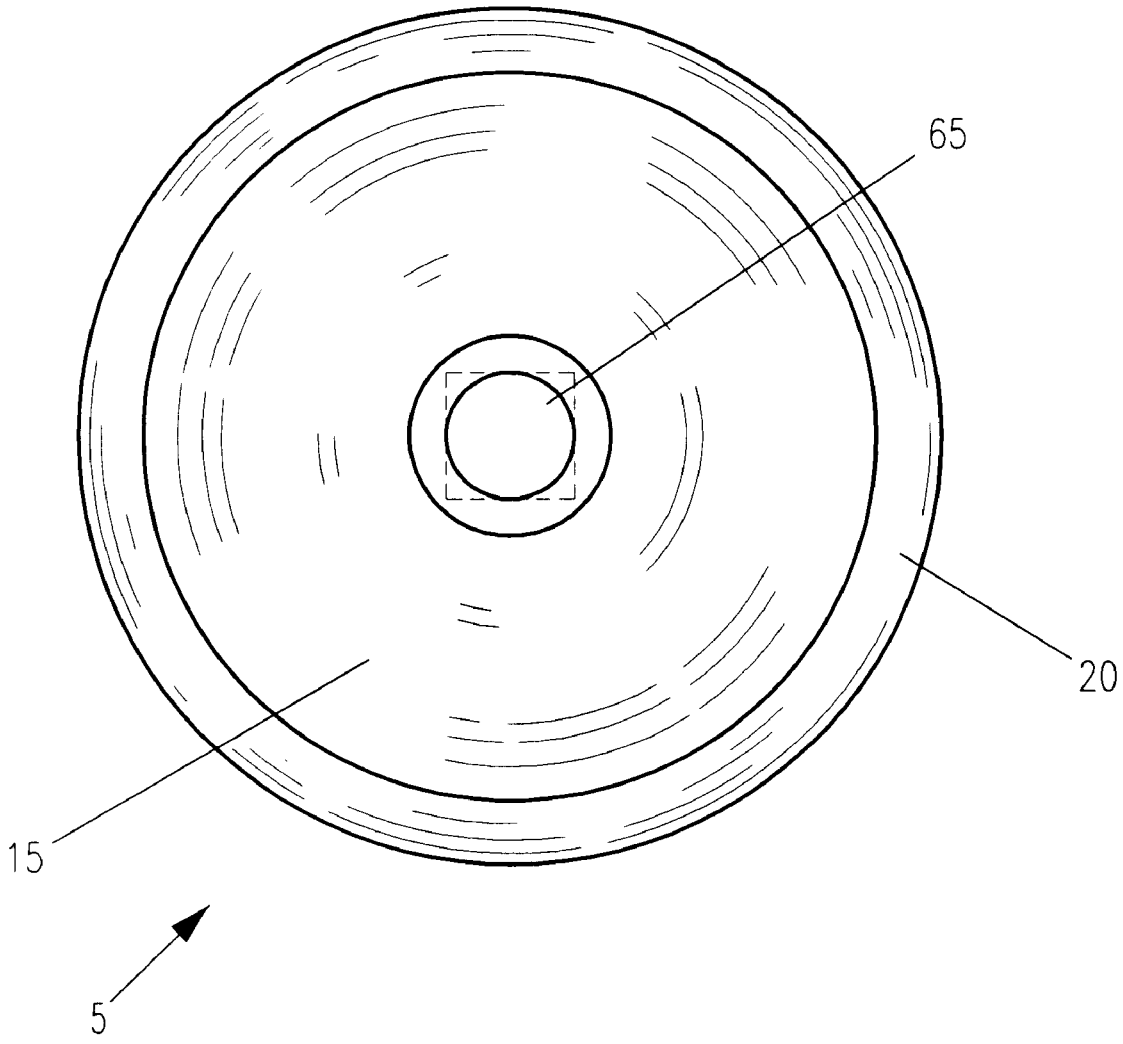
FIG. 2 is a sectional view of the universal, light fixture/ceiling fan recessed mounting device as seen along a line I—I in FIG. 1*a*.

Referring now to FIG. 2, a sectional view of the universal, light fixture/ceiling fan, recessed mounting device 5 as seen along a line I—I in FIG. 1*a* is disclosed. The universal, light fixture/ceiling fan, recessed mounting device 5 with its integral concave, partial hemispherical surface 15 and trim and attachment molding 20 are of a symmetrical circular shape. An electrical box mounting cavity 65 is provided in the exact center of the concave, partial hemispherical surface 15 for the reception of a conventional round electrical box intended for mounting of ceiling hung light fixtures or ceiling mounted fans or paddle fans. The trim and attachment molding 20 is shown as an integral part of the concave, partial hemispherical surface 15 though it can easily be seen that it could be two different pieces, even manufactured from different material. The process of mounting the universal, light fixture/ceiling fan, recessed mounting device 5 and how it relates to a concave, partial hemispherical surface 15 and trim and attachment molding 20 of an integral nature or of a separate nature will be described in greater detail hereinbelow.

Figure 3:
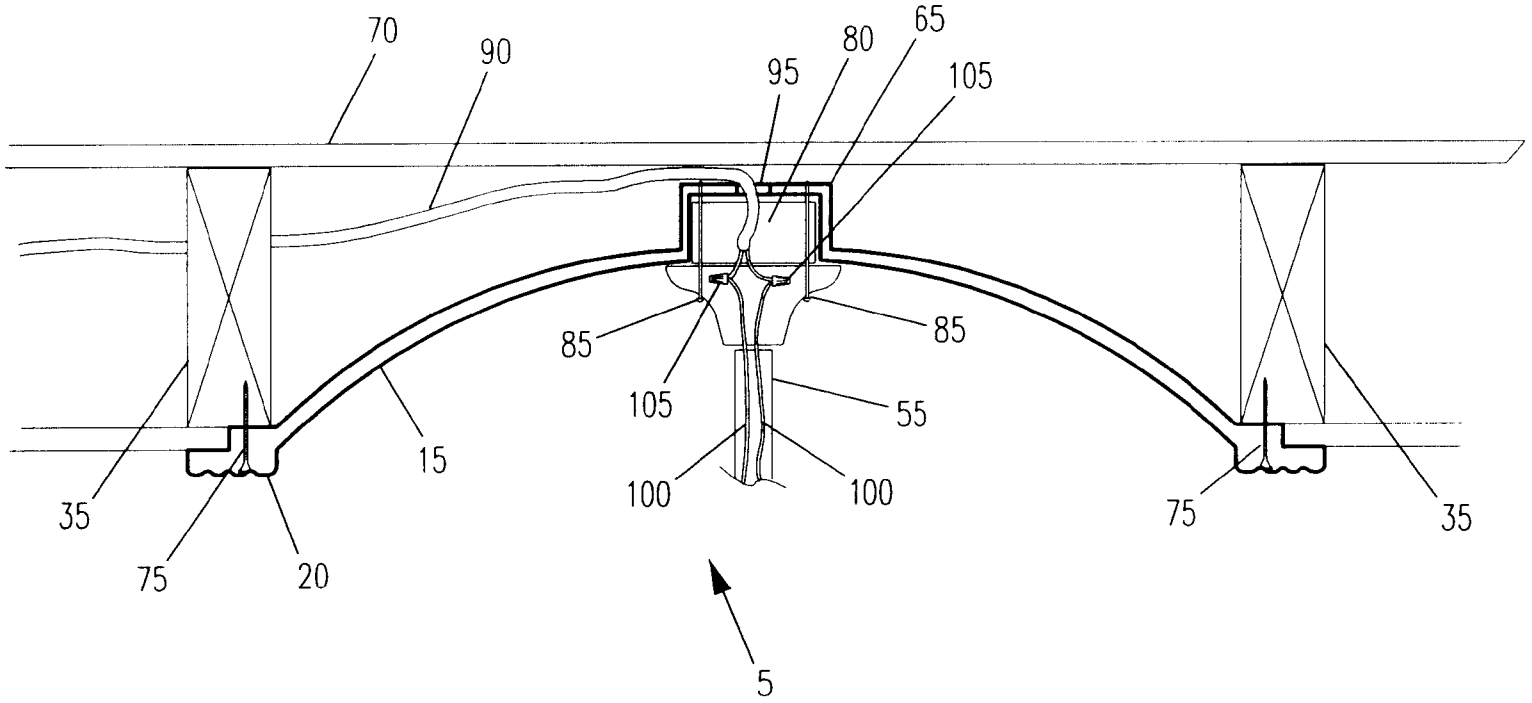
FIG. 3 is a sectional view of the universal, light fixture/ceiling fan recessed mounting device as seen along a line II—II in FIG. 1*a*.

Referring finally to FIG. 3, a sectional view of the universal, light fixture/ceiling fan, recessed mounting device 5 as seen along a line II—II in FIG. 1*a* is disclosed. The volume defined by the concave, partial hemispherical surface 15, the two ceiling rafters or floor joists 35, and the two auxiliary support member 40 (not shown in this FIG.) is bordered on the top by an upper story subfloor 70 in this FIG. Obviously in the case of single story structures there would be only ceiling joists supporting the roof structure or possible trusses. There also may be possible insulation located directly above the concave, partial hemispherical surface 15. However, the presence of insulation will not affect the quality or performance of the universal, light fixture/ceiling fan, recessed mounting device 5. A plurality of fastening means 75, such as nails or screws is used to hold the concave, partial hemispherical surface 15 and the trim and attachment molding 20 to the ceiling rafter or floor joist 35 and the auxiliary support member 40(not shown in this FIG.). This present configuration detailed in this FIG. shows the trim and attachment molding 20 as being an integral part of the concave, partial hemispherical surface 15 with said fastening means 75 fastening the trim and attachment molding 20 directly to the ceiling rafter or floor joist 35 and the auxiliary support member 40 (not shown in this FIG.)thus firmly supporting the concave, partial hemispherical surface 15. In the event of a separate concave, partial hemispherical surface 15 and trim and attachment molding 20, it is visualized that a flange would be provided on the outer circumference of the concave, partial hemispherical surface 15 for the user to fasten said concave, partial hemispherical surface 15 to the ceiling rafter or floor joist 35 and the auxiliary support member 40 (not shown in this FIG.) Then the trim and attachment molding 20 would be fastened over the flange using fastening means 75 as well. This will allow the use of different materials for the concave, partial hemispherical surface 15 and the trim and attachment molding 20. The electrical box mounting cavity 65 houses a conventional round electrical box 80 which is held captive by a plurality of fixture mounting means 85, such as screws. The fixture mounting means 85 passes through the conventional round electrical box 80 and are held captive by the electrical box mounting cavity 65 thus providing a separate means of support for the ceiling fan 50(not shown in this FIG) independent of the conventional round electrical box 80 as required by the National Electrical Code. In this case of a conventional ceiling mount light fixture 10 (not shown in this FIG.) being mounted the fixture mounting means 85 would only be held by the conventional round electrical box 80 as is the conventional practice. The conventional round electrical box 80 would then be held in physical contact with the electrical box mounting cavity 65 by another set of fastening means such as screws. A fixture wiring cable 90 provides electrical power to either the conventional ceiling mount light fixture 10 (not shown in this FIG) or the ceiling fan 50 (not shown in this FIG). The fixture wiring cable 90 passes through a cable entrance hole 95 in the electrical box mounting cavity 65 and enters the conventional round electrical box 80 as would be found in a conventional installation. The individual conductors of the fixture wiring cable 90 would then mate with a series of fixture conductors 100 with the aid of a series of wire fastening means 105, such as wire nuts, or wire crimps. The quantity of fixture conductors 100 and wire fastening means 105 depicted in this FIG. is two, though the quantity can vary depending on the specific parameters of the installation. These parameters include but are not limited to grounding connections, connections for multiple speed ceiling fans, multiple level control for lighting, the use of lighting fixtures with a ceiling fan and the like. The fixture conductors 100 are contained in the pendant rod 55 as would be the case in the use of the universal, light fixture/ceiling fan, recessed mounting device 5 with a conventional ceiling mount light fixture 10 (not shown in this FIG) or a ceiling fan 50(not shown in this FIG).

2. Operation of the Preferred Embodiment

In operation, the present invention can be easily utilized by the common user in a simple and effortless manner. To use the present invention with its preferred embodiment can best be described in conjunction with the perspective views of FIG. 1 and FIG. 1*a*, and the sectional views of FIG. 2 and FIG. 3.

In the instance of new construction, the user would begin installation of the universal, light fixture/ceiling fan, recessed mounting device 5 by installing the pair of auxiliary support member 40 between the ceiling rafter or floor joist 35 at the required spacing. Next, the free end of the fixture wiring cable 90 would be routed through the cable entrance hole 95 of the electrical box mounting cavity 65 and into the conventional round electrical box 80. Now, the universal, light fixture/ceiling fan, recessed mounting device 5 with the integral concave, partial hemispherical surface 15 and trim and attachment molding 20 is ready to be mounted to the ceiling rafter or floor joist 35 and the auxiliary support member 40 by use of the fastening means 75 located in the areas of tangential support surfaces 45. The wiring of the conventional ceiling mount light fixture 10 or the ceiling fan 50 would then commence using the fixture mounting surface 30, the pendant rod 55, the conventional round electrical box 80, the fixture mounting means 85, the fixture wiring cable 90, the fixture conductors 100 and the wire fastening means 105 in a normal conventional manner. The ceiling surface 25 would be then be installed as would be found in a new construction installation. In the case of a sperate trim and attachment molding 20 from the concave, partial hemispherical surface 15, the said trim and attachment molding 20 would be installed last to complete the installation. The conventional ceiling mount light fixture 10 and the ceiling fan 50 would be controlled in a conventional manner using wall switches, pull chains and the like.

In the case of retrofit installation, the user would first locate where the universal, light fixture/ceiling fan, recessed mounting device 5 is to be located in an existing ceiling. Next, an appropriate sized circle would be cut between the ceiling rafter or floor joist 35 and a pair or auxiliary support member 40 would be fastened in using the said cut opening. Installation from this point onward would continue from the routing of the free end of the fixture wiring cable 90 as aforementioned described.

The foregoing description is included to illustrate the operation of the preferred embodiment and is not meant to limit the scope of the invention. The scope of the invention is to be limited only by the following claims.

What is claimed is:

1. A universal light fixture and ceiling fan recessed mounting device comprising:

an inverted concave, partial hemispherical surface;

a fixture mounting surface affixed to and extending downward from said hemispherical surface;

a trim and attachment molding attached to said hemispherical surface, said trim and attachment molding for mounting flush to a ceiling surface;

a ceiling fan: said ceiling fan having a plurality of fan blades;

a pendant rod attached to the fixture mounting surface for allowing the use of said ceiling fan while keeping said fan blades in a close proximity to the ceiling surface, thereby having greater aesthetic appeal in areas where decreased head room underneath said ceiling fan cannot be tolerated;

wherein the inverted nature of the concave, partial hemispherical surface allows for a fixture mounting surface to be mounted above the plane formed by the ceiling surface.

2. The universal light fixture and ceiling fan recessed mounting device of claim 1, wherein the radius of the concave, partial hemispherical surface is allows said surface to be mounted between conventional ceiling support members.

3. The universal light fixture and ceiling fan recessed mounting device of claim 1, further comprising:

a pair of auxiliary support members affixed to said hemispherical surface for mounting in a perpendicular nature to the ceiling rafter or floor joist for providing additional support for said device;

and wherein support is provided by the ceiling rafter or floor joist and the auxiliary support member by a series of four tangential support surfaces, two at each auxiliary support member.

4. The universal light fixture and ceiling fan recessed mounting device of claim 1, wherein said concave, partial hemispherical surface is formed in a decorative design including a member of the group comprising smooth surfaces, fluted surfaces, textured surfaces, and embossed patterns.

5. The universal light fixture and ceiling fan recessed mounting device of claim 1, wherein said mounting device is manufactured from a material selected from the group comprising plastic, fiberglass molding, wood, stamped metal, cast metal, and plaster.

6. The universal light fixture and ceiling fan recessed mounting device of claim 1, further comprising:

an electrical box mounting cavity, said electrical box mounting cavity provided in the exact center of the concave, partial hemispherical surface for the reception of a conventional round electrical box intended for mounting of ceiling hung light fixtures or ceiling mounted fans or paddle fans.

7. The universal light fixture and ceiling fan recessed mounting device of claim 1, wherein said trim and attachment molding is an integral part of the concave, partial hemispherical surface.

* * * * *